US011214453B2

(12) United States Patent
Llorach To et al.

(10) Patent No.: US 11,214,453 B2
(45) Date of Patent: Jan. 4, 2022

(54) MEDIA TRANSFER

(71) Applicant: HEWLETT-PACKARD DEVELOPMENT COMPANY, L.P., Spring, TX (US)

(72) Inventors: Marcel Llorach To, Sant Cugat del Valles (ES); Javier Deocon Mir, Sant Cugat del Valles (ES); Daniel Gonzalez Perello, Sant Cugat del Valles (ES); Joan Singla Mila, Sant Cugat del Valles (ES); Ricardo Sanchis Estruch, Sant Cugat del Valles (ES); Javier Onecha Celestino, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,559

(22) PCT Filed: Jul. 23, 2018

(86) PCT No.: PCT/US2018/043317
§ 371 (c)(1),
(2) Date: Oct. 7, 2019

(87) PCT Pub. No.: WO2020/023013
PCT Pub. Date: Jan. 30, 2020

(65) Prior Publication Data

US 2021/0339971 A1 Nov. 4, 2021

(51) Int. Cl.
*B65H 5/22* (2006.01)
*B65H 3/48* (2006.01)
(Continued)

(52) U.S. Cl.
CPC ..... *B65H 5/228* (2013.01); *B41J 11/007* (2013.01); *B65H 3/48* (2013.01); *B65H 5/021* (2013.01); *B65H 2406/121* (2013.01)

(58) Field of Classification Search
CPC . B65H 3/48; B65H 5/02; B65H 5/021; B65H 5/22; B65H 5/228; B65H 11/002;
(Continued)

(56) References Cited

U.S. PATENT DOCUMENTS 6,340,225 B1 1/2002 Szlucha
7,389,981 B2 6/2008 Lee et al.
(Continued)

FOREIGN PATENT DOCUMENTS

CN 102219125 10/2011
CN 104828592 8/2015
(Continued)

*Primary Examiner* — Prasad V Gokhale
(74) *Attorney, Agent, or Firm* — HP Inc. Patent Department

(57) ABSTRACT

A media transfer system comprising a media drive component and a vent. The media drive component supports and transfers a media in a drive direction. The vent directs air flow towards the leading edge of the media in the drive direction to exert a separating force on the leading edge of the media, the separating force acting on the media away from the media drive component.

15 Claims, 4 Drawing Sheets

(51) Int. Cl.
*B65H 5/02* (2006.01)
*B41J 11/00* (2006.01)

(58) Field of Classification Search
CPC ..... B65H 2406/10; B65H 2406/12; B65H 2406/121; B65H 2406/122; B41J 11/007
See application file for complete search history.

(56) References Cited

U.S. PATENT DOCUMENTS

| | | | |
|---|---|---|---|
| 8,366,101 | B2 | 2/2013 | Morita |
| 8,583,024 | B2 | 11/2013 | Marasco et al. |
| 9,067,439 | B2 | 6/2015 | Herrmann |
| 9,376,276 | B2 | 6/2016 | Yokoya et al. |
| 9,643,806 | B2 | 5/2017 | Shinohara |
| 9,849,695 | B2 | 12/2017 | Zuza Irurueta et al. |
| 2004/0245711 | A1 | 12/2004 | Domoto et al. |
| 2005/0209079 | A1 | 9/2005 | Belmann |
| 2007/0096382 | A1 | 5/2007 | Komori |
| 2016/0152429 | A1* | 6/2016 | La Vos ..... B65H 5/228 271/225 |
| 2017/0253453 | A1* | 9/2017 | La Vos ..... B65H 5/36 |
| 2020/0247148 | A1* | 8/2020 | Hirato ..... B41J 11/007 |

FOREIGN PATENT DOCUMENTS

| | | | |
|---|---|---|---|
| CN | 105600558 | 5/2016 | |
| CN | 205518399 | 8/2016 | |
| CN | 206457058 | 9/2017 | |
| CN | 107531043 | 1/2018 | |
| EP | 0495320 | 7/1992 | |
| EP | 1726549 | 11/2006 | |
| EP | 3025867 | 6/2016 | |
| EP | 3025991 | 6/2016 | |
| EP | 3041683 | 7/2016 | |
| JP | 2010275038 | 12/2010 | |
| JP | 2020125172 A * | 8/2020 | ..... B65H 5/22 |

* cited by examiner

MEDIA TRANSFER

BACKGROUND

A media drive component can be used to support and transfer media in a drive direction. For example, a media drive component may comprise a conveyor belt or roller. Where a conveyor belt is wider than the maximum width of the media, and continuously supports the media over the full width of the media, this may be referred to as a mono belt. Media drive components can be used to transfer diverse types of media, such as sheets or continuous rolls of media such as paper. The media can be of various thickness, the media can be of various amounts of rigidity and the media may be of various widths in a direction perpendicular to the drive direction. A media drive component may form a part of a printing system for transporting printing media from one printing stage to another. For example, a media drive component may transfer media under a print head used to transfer printing liquid onto the media. For a media drive component which supports the full width of the media, there is a homogeneity of contact with the media, and minimal friction of the media against the media drive component.

BRIEF INTRODUCTION OF THE DRAWINGS

Examples of the disclosure are further described hereinafter with reference to the accompanying drawings, in which.

DETAILED DESCRIPTION

Figure 1:
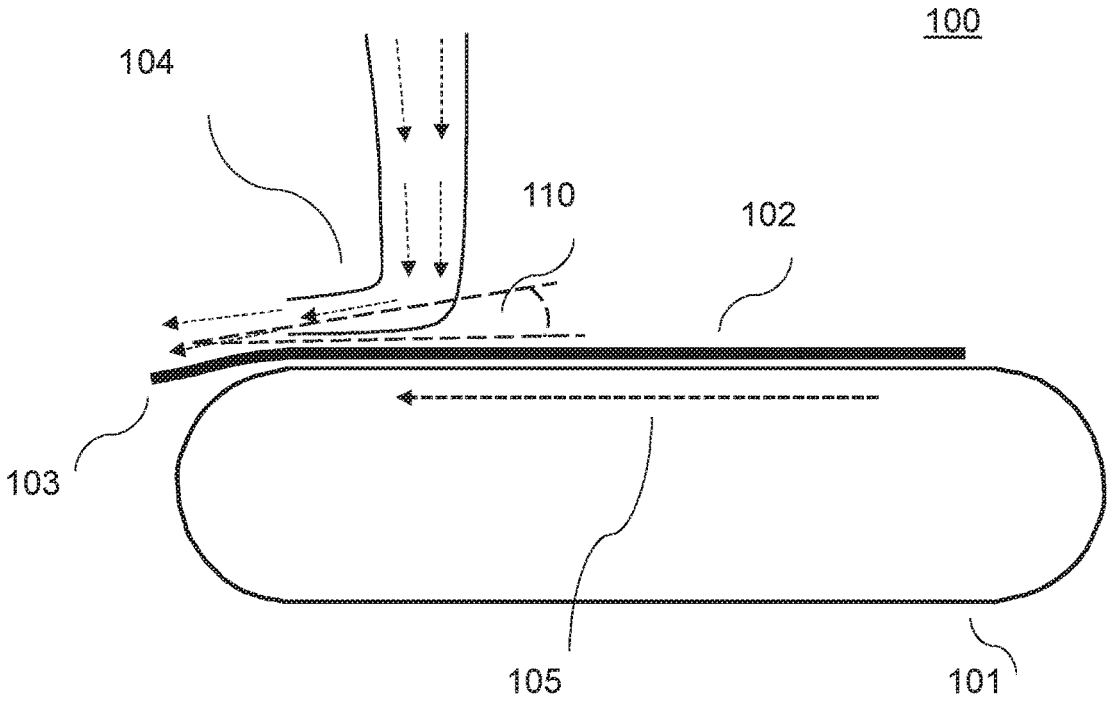
FIG. 1 shows a media transfer system according to an example of the disclosure.

Printing systems, which are used to transfer printing liquid onto a media, may vary depending on a number of factors. For example, the size of the media, the type of the media, and the type of printing can all affect the structure of the printing system. The printing industry is focusing on improving the versatility of their media printing systems, by allowing a wider range of media to be used in the one printing system.

Examples of media can include paper of various thickness and types, fabrics, sheets of material, or any membrane, web, or film of material. The media can be in the form of separated sheets or continuous rolls. For large format printing the media may typically be between 11 inches and 128 inches wide. It will be appreciated that the definition of what is considered to be large format may vary such that the minimum width may be less than or greater than 11 inches and the maximum width may be less than or greater than 128 inches.

Printing systems include a means of transferring media from one section or part of the printing system to a subsequent section or part of the printing system. For example, the sections of a printing system can include one or more of a printing station, a dryer, a stacker and a duplexer.

A media transfer system may comprise a media drive component to transfer the media. A media drive component may comprise a conveyor belt or mono-belt. Alternatively, a media drive component may comprise a roller or other device that supports and transfers the media. A media drive component allows the transport of media from one part of a printing system to another part of the printing system, as well as supporting the media within a part of a printing system such as a printing station. A media drive component may be sized appropriately to operate upon a specified width or range of widths of media. Media drive components may also allow media to be transferred in other types of system, for example a media drive component can be used in the transfer of paper in a paper mill, during the process of manufacturing or transporting paper.

A media drive component can be used to define a path that a media travels, where a media path is the direction of travel of a media in a media transfer system. The direction of travel may also be referred to as the drive direction.

In an example of the present disclosure, a media drive component supports a media across the full width of the media, such that the media is uniformly in contact with the media drive component. As noted in the background section, such a media drive component may comprise a conveyor belt, which may also be referred to as a mono-belt. As the media may be uniformly in contact with the media drive component, friction between the media and the media drive component may be reduced, at least relative to a media drive component in which a portion of the width of the media is unsupported. A reduction in friction of the media may reduce negative impacts associated with the media, particularly when printing on the media, when the media is being transferred by the media drive component. For example, a reduction in friction can reduce the occurrence of smudging of ink on a media or damage to the media when being transferred by the media drive component.

When transferring media between systems, for instance from a media drive component to either a subsequent media drive component or a different form of system, such as may occur in a large format printing system, there is a tendency for the media to stick to the media drive component, which can result in a media jam. For example, for a media drive component comprising a conveyor belt or mono-belt, this may be structured as a continuous band extending around internal rollers such that the band travels in a first direction supporting a media and then turns through 180 degrees about a roller and returns in the opposite direction. There may be a tendency for media to stick to the band of the conveyor belt as it moves from a substantially flat first section moving in the first direction to a curved portion travelling around the roller. This tendency of a media to stick to a media drive component is especially prevalent when the media is from a rolled source, which tends to curl the media, and makes it more likely to stick to the media drive component. Static electricity may also cause the media to stick to the media drive component. One approach to minimising media jams is to manually feed media from the media drive component. Alternatively, to minimise the risk of media jams, more rigid media may be used, which are less likely to bend or curl and to stick to the mono-belt. Scrapers may be used to physically deform the leading edge of a media to allow it to separate from a media drive component. However, scrapers risk damage to the media drive component, and can damage the media.

FIG. 1 shows a media transfer system 100 according to an example of the disclosure. The media transfer system of FIG. 1 comprises a media drive component 101, e.g., a conveyor such as a mono-belt. The media drive component comprises a moving surface that supports a media 102 on an upper side and moves the media 102 in a drive direction 105. The media 102 is transferred in the drive direction 105 towards a downstream end of the media drive component 101. The downstream end of the media drive component 101 is the end of the media drive component 101 at which the media 102 is transferred to a subsequent system or to any subsequent equipment in a system. At this point, the media drive component curves downwards and the media should separate from the media drive component for onwards transfer. A vent 104 directs air flow towards the media 102, to separate the media 102 from a support surface of the media drive component 101.

In some examples of the disclosure, the vent is located at the downstream end of the media drive component 101, so that air flow directed by the vent 104, is directed towards a leading edge 103 of the media 102. The airflow may be directed to flow across the leading edge 103 of the media 102, generally in the drive direction 105. As is evident in FIG. 1, the media 102 is transferred by the media drive component 101 such that it travels between the media drive component 101 and the vent 104. In the orientation illustrated in FIG. 1 the vent 104 is located above the media 102 and the media drive component 101 is underneath the media 102. The airflow is generally in the drive direction 105, but may be inclined towards the plane of the media supported on the media drive component. That is, the air flow may parallel to the 102 and the drive direction 105. Alternatively, a major component of the air flow may be in the drive direction 105 and a minor component of the air flow may be normal to the drive direction such that the air flow impacts upon the media 102. The air flow may be inclined towards the media 102 by an air flow angle 110 shown in FIG. 1, e.g., 5 to 10 degrees, such that the air flow impacts on the upper surface at a shallow angle. The presence of the media 102 and the media drive component 101 serve to cause the air flow to progress from the vent 104 parallel to the media 102.

The media drive component 101 supports the media 102 on a support surface of the media drive component while the media 102 is being directed in a drive direction 105, where the drive direction 105 may also be called a transfer direction. In some examples of the disclosure, the media drive component 101 supports the media 102 across the full width, so that the media 102 is prevented from sagging or deforming.

The air flow towards the leading edge of the media 103 causes a separating force to be exerted on the leading edge 103 of the media 102. The separating force may cause the leading edge 103 of the media 102 to separate from the support surface of the media drive component 101 according to the Bernoulli principle, as described below. However, even if the separating force does not suffice to cause separation, it acts on the media 102 to reduce the force between the media 102 and the media drive component 101. The vent 104 may comprise an orifice which extends across the width of the media drive component perpendicular to the drive direction, and positioned close to the media. As described below in connection with FIG. 4, the vent may be coupled to a fan to supply the air flow. The vent 104 is shown curved such that the air flow originates vertically above the media drive component. This arrangement is merely one example and serves to conserve space above the media drive component.

In an example of the disclosure, the vent 104 is positioned at the downstream end of the media drive component 101, where the downstream end of the media drive component 101 is the end of the media drive component 101 at which the media 102 is transferred to a subsequent system or to any subsequent equipment in a system.

As the vent 104 directs air flow towards or across across the leading edge of the media 103, the air pressure above the leading edge of the media 103, where the air flow is being directed, is reduced according to Bernoulli's principle. The reduction in air pressure causes lift, causing the leading edge of the media 103 to separate from the support surface of the media drive component 101. The lift of the leading edge of the media 103 may oppose the weight of the leading edge of the media 103 or any sticking of the leading edge of the media 103 to the media drive component 101, or the effect of curling on the media. For example, the leading edge of the media 103 may stick to the media drive component 101 due to static electricity attracting the leading edge of the media 103 to the media drive component 101. As the leading edge of the media 103 is lifted, the leading edge of the media 103 is prevented from lifting further than parallel to the direction of air flow, as any further lift may cause the airflow to force the leading edge of the media 103 downward toward the parallel position.

By directing air flow towards the media in the drive direction, such that the air flow passes over the leading edge of the media 103, a separating force is exerted on the leading edge. If the separating force surpasses the combined force of the weight of the media, friction or static attraction between the media and the media drive component and any downwards force present from curling of the media, the leading edge of the media may detach from the media drive component, without affecting the media drive component by physical contact. Furthermore, by reducing physical contact with the media, damage to the media can be reduced, and damage to the quality of print on the media surface can be reduced, for example by avoiding smears of ink and marks on the image.

It will be appreciated that the air flow may be directed from the vent in the drive direction continuously or semi-continuously. In an alternative, the airflow may be switched on and off such that it is on during periods in time associated to the pass of a leading edge of the media under the vent. It will be appreciated that the air flow need not be switched on exactly as the leading edge of the media passes the vent. For instance, a predetermined delay may be applied. For a discontinuous air flow the air flow may be switched on such that the separating force is exerted as the leading edge of the media reaches a position towards the downstream end of the media drive component where it is desirable to reduce the force between the media and the media drive component. For instance, for the shape of media drive component shown in FIG. 1, it is desirable that the separating force is exerted on the leading edge 103 of the media 102 at least as the leading edge reaches the end of the flat upper section of the media drive component and the start of the curved return path of the media drive component.

Figure 2:
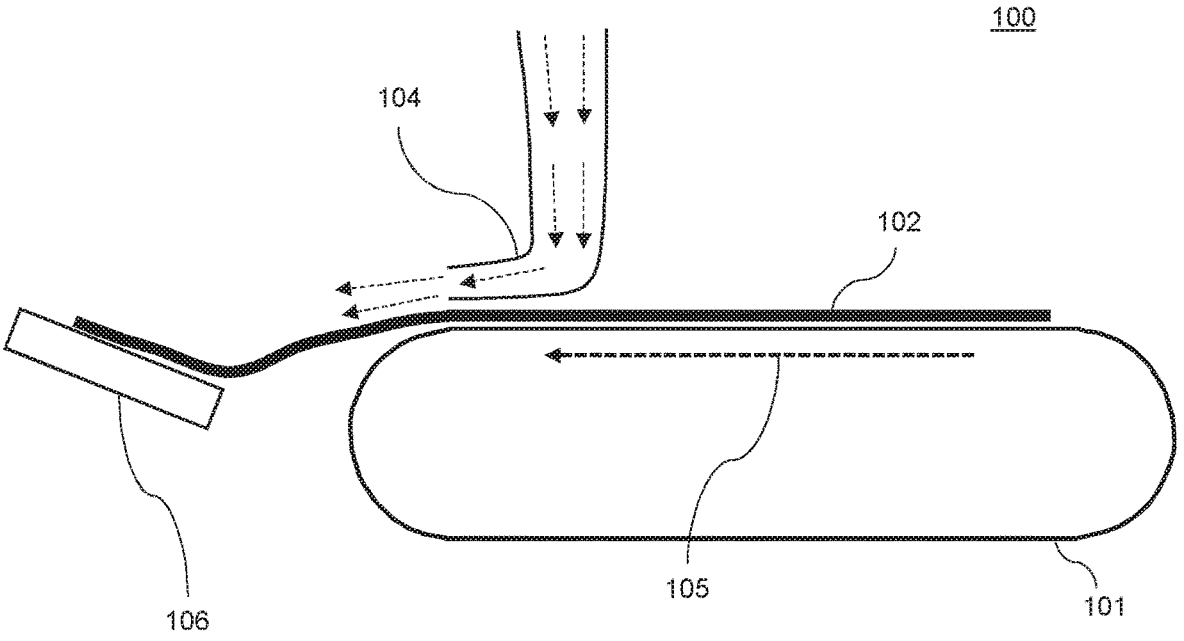
FIG. 2 shows a media transfer system according to a further example of the disclosure.

FIG. 2 shows a media transfer system 101 according to a further example of the disclosure. The media transfer system of FIG. 2 comprises a media drive component 101, which is moving in a drive direction 105. A media 102 is being directed in the drive direction 105 so that the media is transferred to the downstream end of the media drive component 101. A vent 104 directs air flow towards the media 102, to separate the media 102 from a support surface of the media drive component 101. A platform 106 is located proximal to the downstream end of the media drive component 101 in the drive direction. As discussed above, the air flow exerts a separating force on the media. The effect of the separating force is that as the media reaches the downstream end of the media drive component the media travels towards the platform rather than following the return path of the media drive component. As illustrated, the media 102 may not continue in the same plane as the portion of the media supported by the media drive component. Rather, the weight of the media may exceed the separating force exerted by the air flow once the media is unsupported by the media drive component. The platform 106 is located such that the leading edge 103 of the media 102 travels over the platform 106 and makes contact with the platform 106.

The platform 106 shown in FIG. 2 is located between the media drive component 101 and a subsequent equipment (not illustrated), such that the platform 106 guides the media 102 from the media drive component 101 to the subsequent equipment. The platform 106 of FIG. 2 is positioned at the downstream end of the media drive component 101 in the drive direction 105. The platform 106 can be inclined relative to the plane of the media 102 supported on the media drive component 101. The inclination may be approximately 5-10°. The side of the platform 106 which is proximal to the media drive component 101 may be lower than the leading edge of the media 103 as it separates from the media drive component 101. This lowered proximal side of the platform 106 ensures that even if the leading edge 103 of the platform 102 sags below the top level of the media drive component 101, it still makes contact with the upper surface of the platform 106. This stops the media 102 from becoming trapped between the platform and the media drive component. The platform 106 may support a media 102 across the full width of the media 102, such that the media 102 is uniformly in contact with the platform 106.

In another example of the disclosure, the platform 106 of FIG. 2 is used to guide the media 102 to the subsequent system, from the media drive component 101. The platform 106 allows a wider range of media 102 to be used, with a wider variety of material properties, such as rigidity or stiffness. If the leading edge of the media 103 is beyond a threshold length, or if the media 102 is below a threshold rigidity, the air flow from the vent 104 may introduce instabilities or turbulence into the air flow at the leading edge of the media 103, so that the leading edge of the media deforms. Such deformation could cause media jamming or deform the media 102 so that the media path of the media 102 is changed, or it could damage the media 102, or lead to deterioration of a printed image on the media 102. In an example of the disclosure, the platform 106 may be located at a distance of approximately 10-30 cm from the media drive component. However, the distance of the platform 106 from the media drive component 101 can be smaller or larger than this example depending on the configuration of the system and media 102. In another example of the disclosure, the platform 106 can be positioned adjacent to the media drive component 101.

Figure 3:
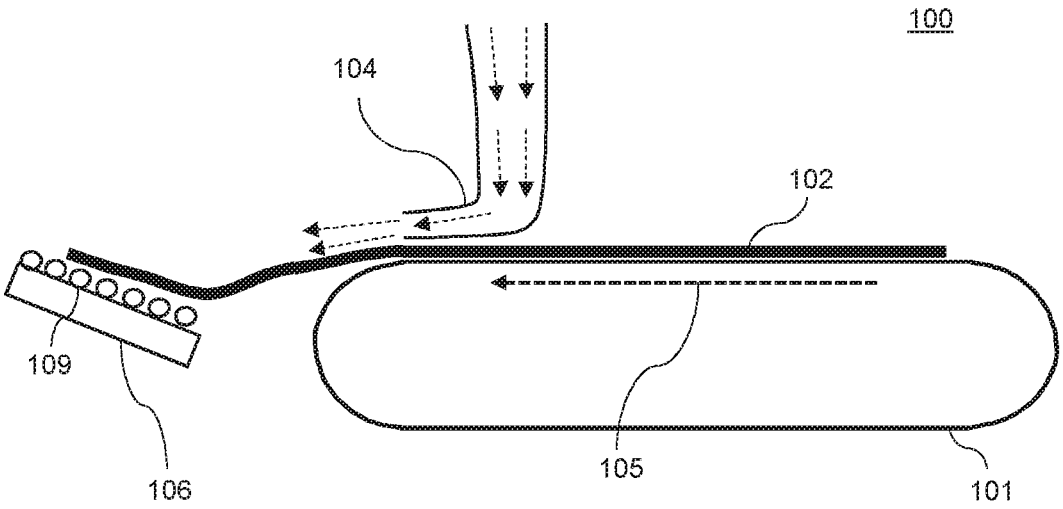
FIG. 3 shows a media transfer system according to a further example of the disclosure.

FIG. 3 shows a media transfer system according to a further example of the disclosure. The media transfer system of FIG. 3 comprises a media drive component 101, which is moving in a drive direction 105. A media 102 is being directed in the drive direction 105 so that the media may reach the downstream end of the media drive component 101. A vent 104 directs airflow across the media 102, to separate the media 102 from a support surface of the media drive component 101. A platform 106 which is located proximal to the media drive component 101, and which supports the leading edge of the media 103 as it separates from the media drive component 101. If the friction of the media 102 in contact with the platform 106 is high, the media can be caused to deform and may be damaged, or the media 102 can diverge from a media path, which can lead to media jamming.

The platform 106 of FIG. 3 includes a friction reduction mechanism according to an example of the disclosure. The friction reduction mechanism can be rollers 109, for example the rollers 109 can be active or passive rollers in an example of the disclosure. The active rollers are driven to rotate so that friction is reduced of a media with a media path across the active rollers and they encourage a media to travel in a direction of rotation of the active rollers. Passive rollers are non-driven and can therefore rotate when a media with a media path across the passive rollers is passed across the passive rollers. In another example, the friction reduction mechanism can include a platform 106 with a surface which has a low friction coefficient, or it can include a surface which has a lubricant to reduce friction. In another example the friction reduction mechanism could be a conveyor belt. That is, the platform may itself comprise or incorporate a conveyor belt.

Figure 4:
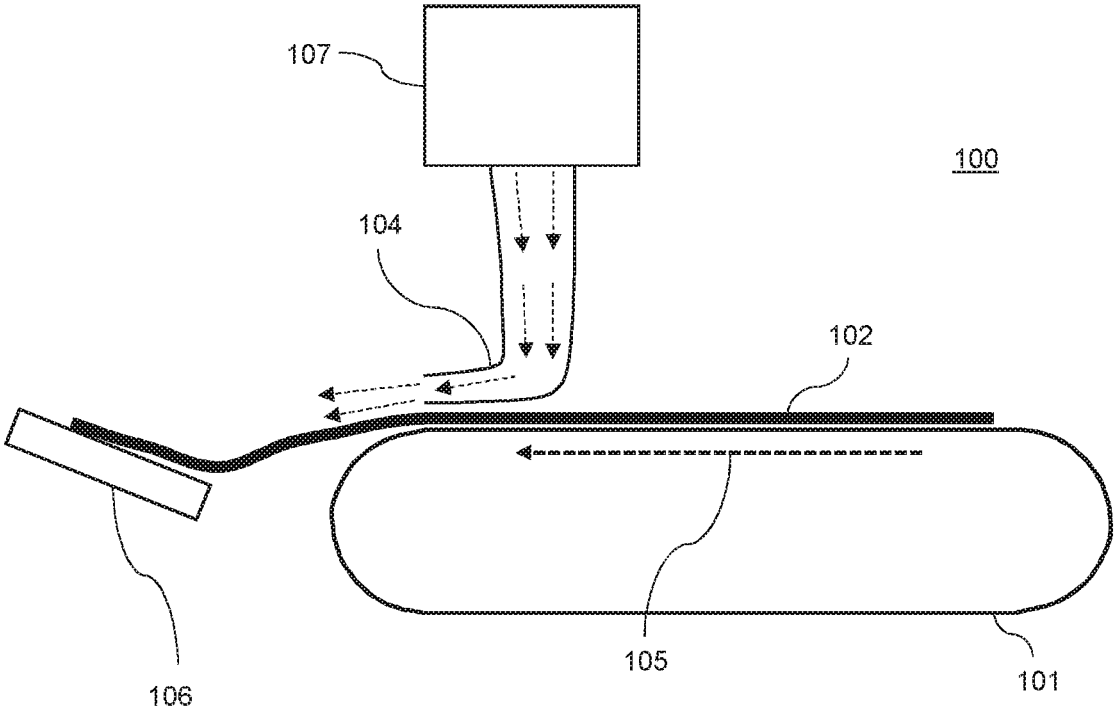
FIG. 4 shows a media transfer system and a coupled fan according to an example of the disclosure.

FIG. 4 shows a media transfer system as shown in FIG. 3, and a coupled fan, according to an example of the disclosure. The media transfer system of FIG. 4 comprises a media drive component 101, which is moving in a drive direction 105. A media 102 is being directed in the drive direction 105 so that the media may reach the downstream end of the media drive component 101. A vent 104 directs air flow across the media 102, to separate the media 102 from a support surface of the media drive component 101. A platform 106 is located proximally to the media drive component 101 and supports the leading edge of the media 103 as it separates from the media drive component 101. A fan 107 is coupled to the vent 104 to generate a flow of air. In another example two or more fans may be provided. The at least one fan 107 can be a part of the media transfer system 100, or it can be a separate component not forming a part of the media transfer system 100. For example, the at least one fan 107 can be a large air generation unit for a building or a large dedicated fan for providing a flow of air to the vent 104. In another example, the at least one fan 107 can be a plurality of smaller fans 107.

Figure 5:
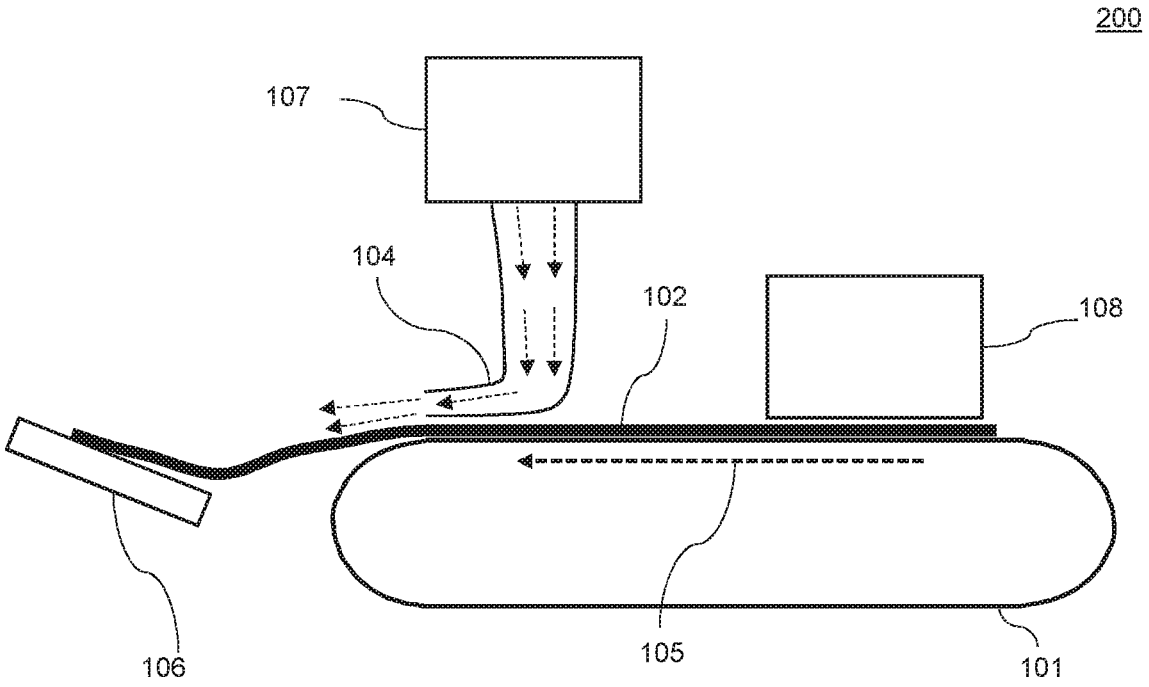
FIG. 5 shows a printing system according to an example of the disclosure.

FIG. 5 shows a printing system 200 according to an example of the disclosure. The printing system 200 of FIG. 5 comprises a media drive component 101, which is moving in a drive direction 105. A media 102 is being directed in the drive direction 105 so that the media may reach the downstream end of the media drive component 101. A vent 104 directs air flow towards the media 102, to separate the media 102 from a support surface of the media drive component 101. A platform 106 is located proximally to the media drive component 101 and supports the leading edge of the media 103 as it separates from the media drive component 101. A print head 108 transfers ink onto a media 102. The media drive component 101 of FIG. 5 is positioned under the print head 108 of the printing system 200, so that the media path of media 102 being transferred by the media drive component 101 can allow the print head 108 to transfer ink to the surface of the media 102.

In another example of the disclosure, the media drive component 101 may not be positioned under the printhead 108. For instance, the media drive component may serve to transfer the media from the printhead to another part of the printing system without directly supporting the media during printing.

Figure 6:
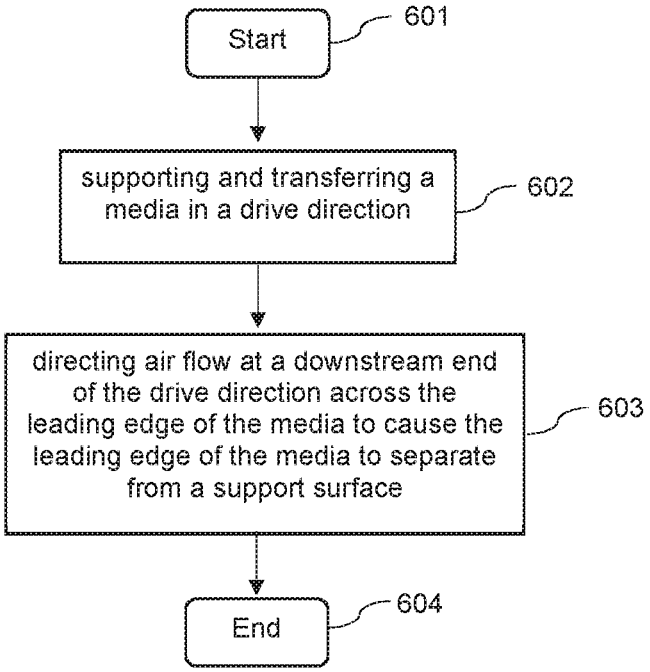
FIG. 6 shows a method according to an example of the disclosure.

FIG. 6 shows a method according to an example of the disclosure. The method of FIG. 6 can be performed by the media transfer system 101 of FIG. 1. At 601, the method according to an example of the disclosure starts. At 602, the method discloses supporting and transferring a media in a drive direction. The media drive component performs this support and transfer role. At 603, the method discloses directing air flow at a downstream end of the drive direction across the leading edge of the media to cause the leading edge of the media to separate from a support surface. This process is performed by the vent. At 604, the method according to an example of the disclosure ends.

Figure 7:
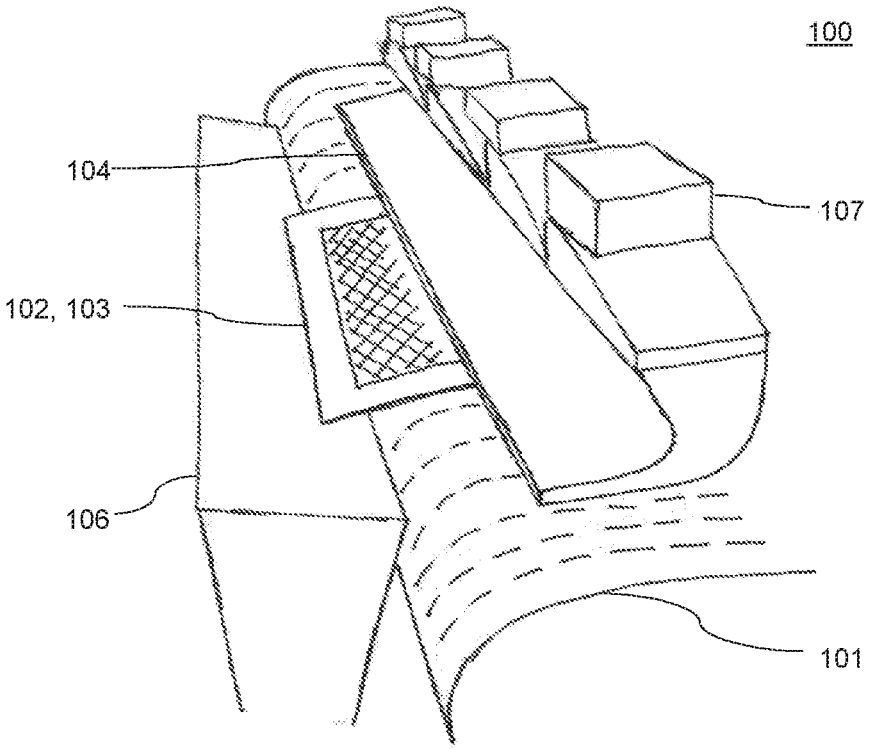
FIG. 7 shows a perspective view of a media transfer system according to an example of the disclosure.

FIG. 7 shows a perspective view of a media transfer system according to an example of the disclosure. The perspective view of the media transfer system of FIG. 7 comprises a media drive component 101, which is moving in a drive direction 105. A media 102, 103 is being directed in the drive direction 105 so that the media may reach the downstream end of the media drive component 101. A vent 104 directs air flow across the media 102, 103, to separate the media 102, 103 from a support surface of the media drive component 101. A platform 106 is located proximally to the media drive component 101 and supports the leading edge of the media 103 as it separates from the media drive component 101.

The invention claimed is:

1. A media transfer system comprising:

a media drive component to support and transfer a media in a drive direction; and a vent to direct air flow from above towards the leading edge of the media in the drive direction to exert a separating force on the leading edge of the media, the separating force acting on the media away from the media drive component.

2. The media transfer system of claim 1, further comprising:

a platform located proximal to the media drive component to support the leading edge of the media as it separates from the media drive component.

3. The media transfer system of claim 2, wherein the platform is located between the media drive component and a subsequent equipment such that the platform guides the media from the media drive component to the subsequent equipment.

4. The media transfer system of claim 3, wherein the platform is positioned downstream from the media drive component in the drive direction.

5. The media transfer system of claim 3, wherein the platform comprises active or passive rollers to support the media such that friction between the media and the platform is reduced.

6. The media transfer system of claim 2, wherein the platform is inclined relative to the plane of the media supported on the media drive component.

7. The media transfer system of claim 6, wherein the inclination is such that a side of the platform which is proximal to the media drive component is lower than the leading edge of the media as it separates from the media drive component.

8. The media transfer system of claim 1, wherein the media drive component supports the media across their full width.

9. The media transfer system of claim 8, wherein the media drive component is a conveyor belt which provides continuous support to media across its full width.

10. The media transfer system of claim 1, wherein the vent extends across the width of the media drive component.

11. The media transfer system of claim 1, wherein the vent comprises a slit extending transverse to the drive direction and positioned relative to the media drive direction such that the airflow is inclined towards the media supported on the media drive component.

12. The media transfer system of claim 1, wherein the vent is positioned at the downstream end of the media drive component in the drive direction.

13. The media transfer system of claim 1, wherein the air flow is generated by at least one fan coupled to the vent.

14. A printing system comprising:

a print head to transfer printing liquid onto a media;

a media drive component to support and transfer the media in a drive direction; and a vent to direct air flow from above towards the leading edge of the media in the drive direction to exert a separating force on the leading edge of the media, the separating force acting on the media away from the media drive component at a downstream end of the media drive component.

15. A method for transferring media comprising:

supporting and transferring a media in a drive direction on a media drive component; and directing air flow from above towards the leading edge of the media to exert a separating force on the leading edge of the media, the separating force acting on the media away from the media drive component.

* * * * *